US006998807B2

(12) United States Patent
Phillips et al.

(10) Patent No.: US 6,998,807 B2
(45) Date of Patent: Feb. 14, 2006

(54) ACTIVE SENSING AND SWITCHING DEVICE

(75) Inventors: David L. Phillips, Santa Ana, CA (US); William B. McDonough, Huntington Beach, CA (US); Ned M. Santos, Lake Forest, CA (US); Rufino Naval, Jr., San Juan Capistrano, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/818,197

(22) Filed: Apr. 5, 2004

(65) Prior Publication Data

US 2004/0213676 A1 Oct. 28, 2004

Related U.S. Application Data

(60) Provisional application No. 60/465,717, filed on Apr. 25, 2003, provisional application No. 60/514,861, filed on Oct. 27, 2003.

(51) Int. Cl.
*H02P 7/00* (2006.01)

(52) U.S. Cl. ..... 318/455; 363/65; 361/87

(58) Field of Classification Search ..... 318/434, 318/455, 442, 430, 276, 109, 732; 361/31, 361/87, 23, 90, 94, 431; 363/49, 56, 60, 363/65, 67, 80, 81, 89; 323/282–286, 267, 323/272

See application file for complete search history.

(56) References Cited

U.S. PATENT DOCUMENTS 3,824,852 A 7/1974 Otto
4,286,303 A 8/1981 Genheimer et al.
4,499,385 A 2/1985 Slavik
4,541,029 A * 9/1985 Ohyama ..... 361/31
4,617,472 A 10/1986 Slavik
4,620,835 A 11/1986 Bell
4,703,387 A 10/1987 Miller
4,722,018 A 1/1988 Pohl
4,722,019 A 1/1988 Pohl
5,076,763 A 12/1991 Anastos et al.
5,473,497 A * 12/1995 Beatty ..... 361/23
5,577,890 A 11/1996 Nielsen et al.
5,624,237 A 4/1997 Prescott et al.
5,670,070 A * 9/1997 Clark et al. ..... 219/130.33
5,675,497 A * 10/1997 Petsche et al. ..... 702/182
5,690,476 A 11/1997 Miller
5,710,723 A * 1/1998 Hoth et al. ..... 702/181
6,059,536 A 5/2000 Stingl

* cited by examiner

*Primary Examiner*—Rajjnikant B. Patel
(74) *Attorney, Agent, or Firm*—Ware, Fressola, Van Der Sluys & Adolphson LLP

(57) ABSTRACT

An active sensing and switching device for use in controlling current to a load, comprising a controller means (U1) for disconnecting the load from a power source by providing a switch-open control signal based on a signal indicating a sensed value of electrical current to the load, characterized in that the controller means (U1) determines a nominal value for the electrical current to the load based on monitoring the signal indicating the sensed value of electrical current to the load. A load control system is also provided, including a single ASSD adapted to receive signals indicating sensed values of electrical current to a plurality of respective loads, and further comprising a plurality of load control modules adapted so as to be disposed in proximity to respective loads or a main power line, wherein the load control modules provide respective signals indicating sensed values of electrical currents to the respective loads.

14 Claims, 3 Drawing Sheets

ACTIVE SENSING AND SWITCHING DEVICE

CROSS REFERENCE TO RELATED APPLICATION

Reference is made to and priority claimed from U.S. provisional application Ser. No. 60/465,717, filed Apr. 25, 2003, entitled ACTIVE SENSING AND SWITCHING DEVICE.

Reference is also made to and priority claimed from U.S. provisional application Ser. No. 60/514,861, filed Oct. 27, 2003, entitled LOAD CONTROL SYSTEM.

TECHNICAL FIELD

The present invention pertains to the field of protecting a motor or other kind of load caused by too much or too little current being supplied to (or drawn by) the load (e.g. in case of a fluid pump motor, in situations where the fluid is at least temporarily blocked and so the pump is operating in a so-called run-dry condition). More particularly, the present invention pertains to a sensing and switching device for use in protecting a load.

BACKGROUND ART

Fluid pumps manufactured presently often have no protection against run dry events caused by e.g. blockage of the fluid being pumped or other events (such as a locked rotor) that could result in damage to the pumps if power to the pump is not turned off. Correspondingly, pumps manufactured presently often have no capability for detecting a run dry condition or other possible harmful condition. The few models that do have such protection use very simplistic protection mechanisms.

For example, U.S. Pat. No. 5,076,763 discloses a circuit that detects an undercurrent or overcurrent condition (caused by a run-dry condition or a blockage/locked rotor condition), and shuts off the power to the pump motor via a relay. However, the protection circuit there merely operates as a recycling timer. If the condition persists, the unit keeps cycling ON and OFF; however, if the condition does NOT go away, the pump will still destroy itself because it will continue to receive power (intermittently). The '763 patent discloses an undercurrent detector stage, which shuts off a pump motor when an undercurrent is detected caused by the pump beginning to run free due to exhaustion of liquid from the sump or bilge. There is also a teaching that the rest period between turning a pump off after sensing an undercurrent and turning it back on is dictated and controlled by the next prior pumping cycle history of the system. There is however no teaching of turning off the pump indefinitely in the case of reaching a predetermined number of attempts to turn the pump back on and sensing each time an undercurrent condition when turned back on. The protection circuit of the '763 patent can detect and protect against both blockage (increase in current) and loss of fluid (decrease in current). However, it is still merely a recycling timer, and so it will still allow the pump to be damaged by a constant "run dry" condition or blockage. Also, its design is also "pump specific" in that the levels of currents it detects are determined by the values of electronic components in its circuit design. For different pumps and motors, different values are required. Hence different PCB board assemblies and part numbers are required for different pumps. Still also, it also has no diagnostic capability: it gives no indication to the user whether the problem is run-dry, blockage, over temperature, circuit failure, sensor failure, or other condition. Further, it has no temperature sensing capability to protect against overheating; it cannot limit the number of times that a fault condition is allowed, then stop until commanded to reset; it cannot learn or adapt to its environment and change its operation accordingly (for example, adapt to a lower or higher input voltage, or adapt to changing operation parameters due to motor wear); it cannot store information about the pump, such as the serial number, manufacturing numbers, log hours of operation, number of failures, or other historical information of use in diagnosing problems with the pump or of use in preventing problems from occurring.

What is needed is a protection circuit that adapts to the (possibly) changing (e.g. gradually, over time) nominal operating values of the load it is protecting, and, further, is more than a simple recycling timer, turning off power in cased of a sensed abnormal operating condition (undercurrent or overcurrent), and then simply turning on (after a predetermined period) and off again and again as long as the underlying cause persists.

In addition, some loads use large amounts of electrical current. For example, battery-powered vehicle electrical systems carry large electrical currents to their loads (a starter motor, for example), and heavy and expensive copper wiring is required to carry such large electrical currents. The loads in a vehicle are typically controlled from centralized panels (such as a dashboard or equipment panel) and also from distributed locations about the vehicle (such as multiple switches for a water pump on a boat or RV). Using conventional electrical control system approaches, heavy wire must be pulled from the power source to the control switch or switches, and also to the load. The cost, size and weight of the wiring required is often objectionable, and voltage drops because of long wiring runs are characteristically problematic.

Thus, what is also needed is a way to avoid having to use heavy wire to connect the power source to the control switch or switches.

DISCLOSURE OF THE INVENTION

Accordingly, in a first aspect of the invention, an active sensing and switching device is provided for use in controlling current to a load, comprising a controller means for disconnecting the load from a power source by providing a switch-open control signal based on a signal indicating a sensed value of electrical current to the load, characterized in that the controller means determines a nominal value for the electrical current to the load based on monitoring over a period of time the signal indicating the sensed value of electrical current to the load.

In accord with the first aspect of the invention, the controller means may provide the switch-open control signal in case of a difference in the sensed current compared to the nominal value by more than a predetermined amount, and may provide a switch-close control signal after a waiting period but not subsequent switch-close control signals beyond a predetermined number of repetitions in case of repeated indications of sensed current differing from the nominal value by more than the predetermined amount. Further, the controller means may also determine acceptable variations from the nominal value by monitoring the current during a period of providing current to the load.

Also in accord with the first aspect of the invention, the active sensing and switching device may also include sensor signal conditioner means for conditioning the signal indicating the sensed value of electrical current to the load so as to be suitable for use by the controller means, and the sensor signal conditioner means may be an operational amplifier configured as a non-inverting amplifier with a gain of approximately four.

Also in accord with the first aspect of the invention, the controller means may be provided as a microcontroller having flash program memory.

In a second aspect of the invention, a load control system is provided, comprising an active sensing and switching device according to the first aspect of the invention, and adapted to receive signals indicating sensed values of electrical current to a plurality of respective loads, and further comprising a plurality of load control modules adapted so as to be disposed in proximity to respective loads or a main power line, with the load control modules configured to provide respective signals indicating sensed values of electrical currents to the respective loads.

In accord with the second aspect of the invention, the load control module may comprise: switching means for disconnecting the load from a power source in response to a switch-open control signal, and for connecting the load in response to a switch-close control signal; and sensing means for sensing current to the load, and for providing a sensed current signal derived from the sensed current. Further, the sensing means may sense current through a resistor formed as a trace of known resistance and placed in series with the load.

Also in accord with the second aspect of the invention, the active sensing and switching device may provide a command signal to one of the load control modules based not only on a signal from the load control module indicating a sensed value of electrical current to the respective load, but also based on at least one signal from another of the load control modules indicating a sensed value of electrical current to the load to which the other of the load control modules is proximally located.

Also in accord with the second aspect of the invention, the active sensing and switching device may include network communication functionality allowing communication between the active sensing and switching device and the load control modules using a network protocol. Further, the active sensing and switching device may also include a network protocol converter allowing communication between the active sensing and switching device and the load control modules using different network protocols.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION OF THE INVENTION

The Active Sensing and Switching Device

The invention provides an active sensing and switching device (ASSD) 20 (FIG. 1) for a pump that protects a load (of a main power supply) such as a pump motor pump by detecting undercurrent in the load based on a signal provided to an operational amplifier using a means of sensing current to the load, such as a resistor formed as a trace of known resistance in series with the load, and shuts off the power to the load, doing so in some applications indefinitely after cycling the power to the load on and off for a predetermined number of cycles. Further, an ASSD according to the invention can learn what is an acceptable departure from a nominal operating current, i.e. it can adapt to changing operating parameters of the load (parameters that change, e.g. due to changes in the physical characteristics of the load, such as from wear over time).

Figure 1:
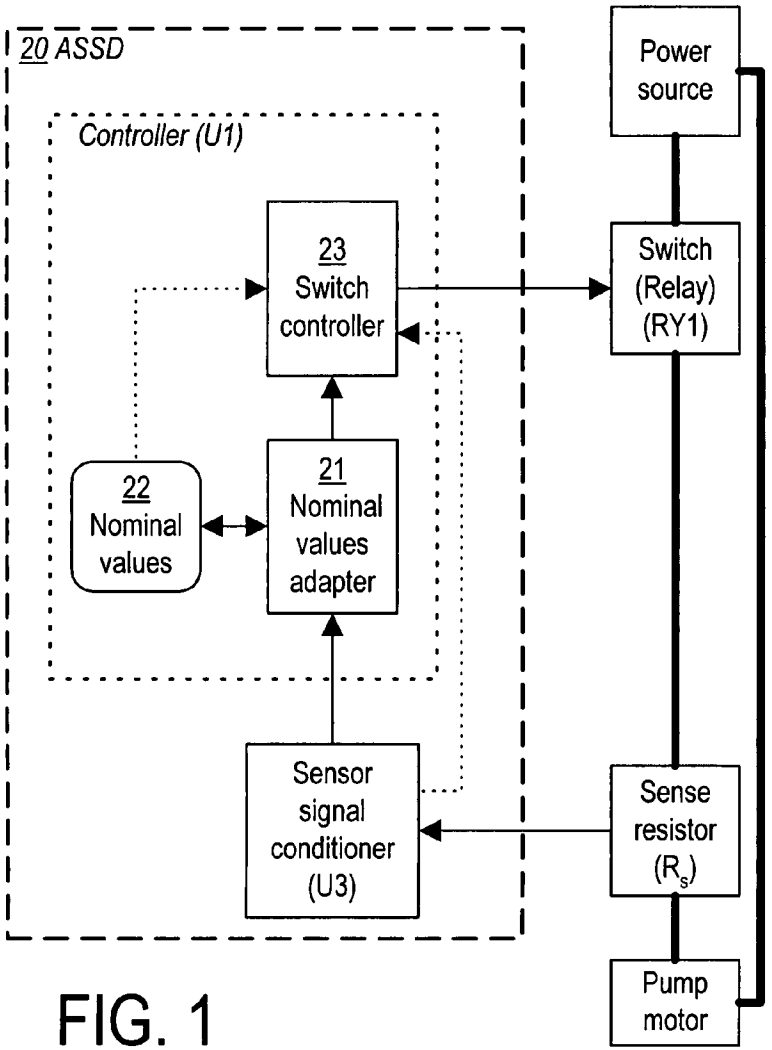
FIG. 1 is a block diagram of the principal components of an active sensing and switching device (ASSD) according to the invention, shown connected to a motor to protect the motor from undercurrent and overcurrent.

Referring to FIG. 1, the basic operation of an ASSD 20 according to the invention is described here in case of use with a pump motor. As more easily seen from FIG. 1, an ASSD according to the invention includes a controller U1 for controlling one or two switches/relays RY1, RY2, . . . (not part of the ASSD 20), all in line with power to the pump motor (so that the controller U1 has pin positions for RY1, RY2, and so on; the controller U1 sends open and close commands to the switch RY1 based on sensor signals it receives obtained using a sensing means (also not part of the ASSD), such as sense resistor $R_s$, also in line (i.e. in series) with the load. The sensor signals are provided to the controller U1 by a sensor signal conditioner after conditioning the signals (e.g. amplifying the signals) so as to be suitable for the controller U1. Of course sense means besides a resistor can be used; e.g. any sort of ammeter can be used, including a galvanometer-based sense means. The controller U1 typically includes a nominal values adapter module 21, that stores in a nominal values data store 21 and possibly modifies nominal values for the current to the pump motor—i.e. acceptable operating values—based on monitoring current to the pump over one or more periods of time. The ASSD 20 can be provided so that a sensor signal conditioner U3 provides sensed current values (after conditioning) to the nominal values adapter module 21, which in turn provides the values to a switch controller 23 (which then provides the open and close commands to the switch RY1, or it can be provided so that the sensor signal conditioner U3 provides the (conditioned) sensed current values (i.e. signals indicating same) to both the nominal values adapter 21 as well as to the switch controller 23. In any embodiment, the switch controller 23 obtains the currently-in-use nominal value for the electrical current for the pump motor (either from the nominal values adapter 21 or directly from the nominal values data store 22), and determines switch open and close commands by comparing the sensed electrical current value with the nominal (electrical current) value. (Note that the use of relays, as opposed to bipolar transistors or MOSFETS, allows "high-side" switching of the positive battery lead to the load, which is compatible with existing electromechanical switches. MOSFETS and transistors are normally "low side," i.e. ground-side switching devices. Thus, the use of relays provides a measure of safety in the event of water reaching the pump; there is no shock hazard. In addition, using relays complies with ABYC and Coast Guard standards.)

When power is applied to the pump and ASSD 20, the ASSD delays a few hundred milliseconds to allow the circuit to stabilize to manage the switch bounce typical of electromechanical switches that control pumps. Then it switches on the pump motor via switch RY1 and delays about 1 second before detecting over-current to allow for the inrush current to subside. It waits approximately 10 seconds to allow the pump to prime, after which it begins to check for loss of fluid. It also acquires a baseline signal from the current sensing to compare with its preprogrammed value. Over time, it averages this value to use as a standard reference and stores this value in its flash data memory.

When a loss of fluid is detected as a significant decrease in current (about 50% or a pre-programmed amount), it waits a small amount of time (a few seconds) to see if the anomaly is eliminated. If not, it shuts the pump motor OFF via RY1 for a variable period of time, first for about 30 seconds. At the end of this timeout, it will restart the pump motor and repeat the above cycle. If the fluid is still not present, it again shuts the pump motor off and waits for a longer period of time, perhaps one minute. It then repeats the above cycle. If fluid is still not present, it shuts off and restarts after perhaps two minutes. If after a limited number of retries determined by comparison to a pre-programmed number stored in memory, it does not restart again. The only way to reset this condition to is to remove power and re-apply it again. Thus after perhaps three to five retries, the system is locked out to prevent any damage to the pump.

Conversely, if a blockage is encountered, the pump motor is shut off within about 100 milliseconds to prevent damage and overheating. If power is still applied, U1 will attempt a restart after about 60 seconds. If the blockage is still present, the pump is again shut off immediately. After about 5 retries, the system will go into lockout until the power is removed.

The device is designed to work with standard rocker or toggle switches with internal illumination. Typically these switches are designed for power switching applications at 10–20 amps and have an internal incandescent lamp or LED. Alternately, it may be used with proprietary pushbutton keypad with internal LED. When either of the above conditions is detected, the diagnostic lamp will blink an error code that is a pre-programmed sequence of blinks. For example, steady ON means pump is running and is OK; 1 blink means a "run dry" condition; 2 blinks means a blockage condition; 3 blinks means an over-temperature condition; 4 blinks can mean an open motor winding condition; 5 blinks can mean the pump has exceeding the normal life of an impeller or service is required; 6 blinks can mean the control switching device (relays) have failed to shut off current to the load (likely from welded contacts or other mechanical failure) and the control needs to be replaced immediately. According to the invention, when installing the invention for use with a pump having a dumb LED-illuminated switch (indicating only ON or OFF), the LED can be adapted/retrofit to operate according to the above or a comparable code (1 blink for "run dry," and so on) so as to provide diagnostics without requiring a unique or custom switch.

If at any time during the operation of the circuit, if a temperature exceeding a pre-determined maximum is detected, U1 will disable the pump until such time as the temperature drops to a second pre-determined value that is safe for resuming operation.

Still referring to FIG. 1, device U1 is e.g. an 8-bit microcontroller device with 1K of flash programmable program memory and 128 bytes of flash non-volatile data memory, as well as a four-channel ten-bit analog-to-digital converter (ADC) and high-current logic outputs. It is the heart of the ASSD and allows the intelligent control, field programmability, and intelligent self-adaptation. It is a fully self-contained mixed-signal (analog and digital) device with internal oscillator and peripherals required to implement the invention. The U1 device used can be a Microchip Technology 12F675 device, available from Microchip Technology, Inc., of Chandler, Ariz., but similar products are available from Texas Instruments, Atmel, Zilog, and other microcontroller manufacturers.

The sensor signal conditioner device U3 is e.g. a low-power low-voltage operational amplifier implemented with CMOS (complementary metal oxide semiconductor) technology to achieve so-called rail-to-rail operation with a single low-voltage (+5V) DC supply. It is configured as a non-inverting amplifier with a gain of about four. It amplifies the current signal developed across the low-resistance discrete resistor $R_s$ (typically about 0.010 ohms). Alternately, it may be formed as a trace of known-resistance in series the motor. It develops a signal having a voltage given by $V_c=I_mR_s$, where $I_m$ is the current to the motor, and $R_s$ is the sense resistance. The signal voltage is amplified by the operational amplifier to produce an amplified signal of about 100 mv/amp, so that at a current of 10 amps (which is typical), the motor current will product a signal of about 1000 mV.

High-current (30 amp inductive) relays typically used in the automotive industry are used as the pump switching devices. For a non-reversing (one polarity) application, only one relay is required, and a jumper wire is inserted between the pins on the U1 device used for any additional relay (RY2, . . . ). In this application RY1 simply switches the battery voltage ON and OFF to the PUMP positive (+) output; the PUMP negative (−) output is always connected to ground.

For reversible applications, a second relay RY2 is required. In such applications with both RY1 and RY2 in the OFF position, both the PUMP positive and PUMP negative terminals are connected to ground. If the unit is energized in the forward direction, RY1 is turned to ON by applying the positive battery voltage to the PUMP positive output, while the PUMP negative output is still at ground. If the unit is energized in the reverse direction, RY2 is turned to ON by applying the positive battery voltage to the PUMP negative terminal, while RY1 is turned to OFF leaving the PUMP positive terminal at ground. Thus a DC pump motor will run clockwise or counterclockwise depending upon the polarity of the voltage applied to it. When OFF, GROUND is applied to both pump motor leads, which provides a measure of safety in the event of water reaching the pump because there is no shock hazard with GROUND so applied.

The signal from sensor signal conditioner device U3 is fed into a low pass filter. The output of this filter is connected to an ADC input of U1, which then digitizes the signal under program control.

A voltage divider formed by resistor $R_s$ and another resistor allows sensing of the input voltage applied to the pump, which in turn can be used to change the thresholds of current settings embedded in U1. For example, a lower line voltage would mean the current thresholds are reduced somewhat. If the line voltage is significantly lower than the expected normal voltage, say below 9V for a 12V system, the unit may elect to turn the pump to OFF for a period of time until the voltage recovers to 11.5 volts or more. This would allow disconnecting the pump under low-battery voltage or starting conditions in the vehicle.

A connector, which may be either a simple connector or a set of pads on the printed circuit board (engaged with a "bed-of-nails" probe), is used to perform In-Circuit-Serial-Programming of device U1. It also can be used to embed pump-specific information into device U1 at the time of manufacturing, information such as serial number and date of manufacture as well as initial operating parameters for the specific pump it is being used with. For example, the normal run current for one model may be 7.5 amps, while for another model it may be 15 amps.

Low-value higher-wattage resistors (0.5 watt) are used in order to conduct a significant amount of the current (about 0.1 amps) through the external switches. Doing so allows the ASSD to work with power switches, which normally are not suited for so-called "dry circuit" or "pilot duty" applications, such as electronic circuits. If the ASSD is to be used with an external keypad using rubber or membrane low-current switches, the resistor values would be raised to about 10K ohms to reduce the current through the switches into the low milli-ampere range. A transistor is used to level-shift the low voltage logic output of U1 in order to drive a 12V incandescent bulb typical of an illuminated rocker switch for automotive applications. It is also capable of driving a low-voltage LED illuminator.

An important benefit of an ASSD according to the invention unrelated to protection is its ability to remotely switch and monitor or diagnose loads that consume large amounts of current (10 to 30 amps) without the need to actually switch the load current at the remote switch location. Typically, if a pump current drain is 10 amps, an electromechanical switch capable of 20 amps minimum is connected through thick low wire gauge (thick) wires capable of carrying the full load current while not dropping much voltage because of the resistance of the wire. In the invention, the high current is switched at the pump load itself, while the connections to the activation switch are a much higher gauge (smaller) wire, which introduces no loss at all to the switched pump. Furthermore, this light wiring harness delivers remote diagnostic capability to the switch itself, which is normally located in a convenient user accessible location. Thus a 30-amp load may be switched and diagnostic indications relayed to distances of 50 feet or more using a small, light, inexpensive wiring harness.

Thus, an ASSD according to the invention can be used to protect any AC or DC operating fluid pump from the loss of fluid resulting in a "run dry" condition that may damage the pump. It can also be used to protect against a blockage or locked-rotor condition, allowing a safe recovery by automatically retrying a programmed number of times (and then stopping). In can be used to provide remote switching of pumps or other high current devices (typically up to 30 amps for the embodiment described above) while requiring only a few milliamps of current (in the above-described embodiment) through the remote switch, greatly reducing the size of the wiring harness and increasing the distance between the switched device (at the pump) and the switch itself. Further, it can be used to remotely diagnose and display potential failures (up to six in the embodiment described above) via a blinking LED or LCD display, to communicate locally or remotely with the user. A device according to the invention can be used to control a reversible pump with all protection and diagnostic capabilities available in both clockwise and counterclockwise operation. The invention provides for maintaining a running log of the total hours of operation and the number and type of anomalies encountered during the life of the pump. Also, it can be used to protect against potential damage to a pump that is otherwise functioning normally but is running under extremely high operating temperatures that could become hazardous. Further, it can adapt how it responds to sensed conditions so as to account for variations in line voltage and motor or pump wear.

Further, an ASSD according to the invention is compatible with existing customer non-pilot duty power switches (rocker, toggle, or momentary) and proprietary low current pushbutton membrane or rubber switches with LED or incandescent illumination. So an ASSD according to the invention is compatible with existing high-current electromechanical systems.

As also noted, an ASSD according to the invention can maintain other maintenance or warranty information that may be interrogated by the manufacturer for quality control, SPC, or confirmation/denial of warranty.

Further Aspects of an ASSD According to the Invention

In determining whether a decrease in sensed current is sufficient to merit turning off power to the pump, it is advantageous in some embodiments to wait momentarily before turning off the power in order to see if the decrease in current persists, including waiting when the pump is first turned on, but also waiting in case of a decrease in current after the pump has had time to stabilize. Further, it is sometimes advantageous to wait for a variable amount of time in between restarts. Further still, it is sometimes advantageous to adjust any factory-set baseline/reference signal (used to gauge whether the decrease in current merits action) based on time-averaging the current sensing signal (and storing the adjusted baseline/reference in memory).

Load Control Module Instead of Merely Sense Resistor and Switch

Figure 2:
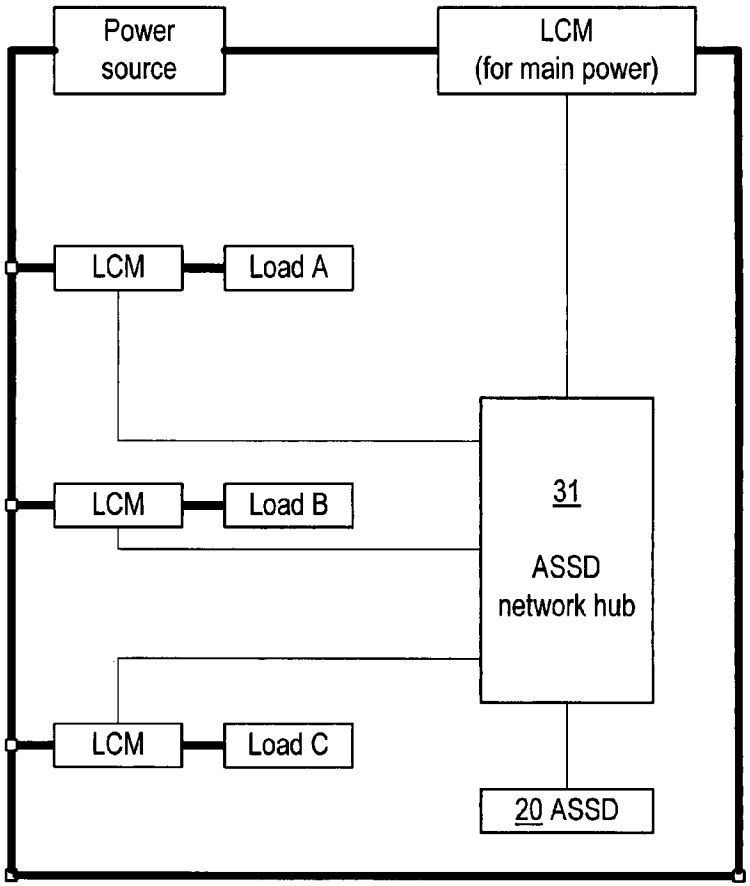
FIG. 2 is a block diagram of a load control system for a piece of machinery having several different loads, and having a single ASSD but having sensor components and switches—or alternatively, load control modules—distributed throughout the piece of machinery connected to the different loads, the ASSD and the distributed components acting in combination to protect the different loads.

Referring still to FIG. 1 and now also to FIG. 2, instead of merely a sense resistor $R_s$ (as the sensing means) and a switch RY1, an intelligent device, called here a load control module (LCM), can be incorporated into (connected to, or attached in line with) the load to provide load control, monitoring and intelligent protection functions as well as the basic sensing function and so serve as the sensing means. According to the invention, an LCM is installed at the point of use, physically proximal to the load being monitored and protected. For example, a LCM for a pump would install a few inches from the pump body, in-line with the power wiring to the pump. As desired, the LCM could report any number of operating parameter values to the controller U1 or even to an external central control panel perhaps monitored by an operator or programmed to act autonomously, so as to provide higher levels of control and monitoring based on the sensed parameters.

LCMs according to the invention are used to provide a system-level solution that optimizes power distribution by separating control and monitoring functions from the distribution of electrical power. The control modules may appear as a family of devices suited to different and various loads. An LCM used with the invention can be simple or complex, as required by the application, and are typically microcontroller-based for maximum adaptability and function.

Examples of functions envisioned for the LCM: electrical and environmental parameter monitoring, such as pressure, flow, motion, temperature; intelligent parameter interpretation, such as pump behavior; and intelligent protection, such as over-temperature shutdown and over-current protection. An LCM can be configured to provide either simply load control (including monitoring parameters required for load control), or multi-parameter monitoring (including parameters not necessarily required for load control), or of course both.

LCMs are preferably provided so as to be compatible with conventional (simple/dumb) control switches in case of applications having simple requirements. Advanced system functionality can include bi-directional communications with a central console. Communication between the LCMs and the central console can be network-based, carried by any number of physical signal mediums including the vehicle chassis, dedicated wiring, power-line carrier, and RF (wireless, i.e. using air as the physical medium). The central console can thus be remote. For example, the LCMs can be provided so as to communicate with a vehicle monitoring service such as ONSTAR (R), provided by OnStar (of which General Motors is a parent company), of Troy, Mich.

Load Control System

The invention is of use in avoiding using heavy wiring when it is really not needed. As indicated in FIG. 1 using heavy weight lines to indicated connections using heavy gauge wiring, and using lighter weight lines to indicate conductors carrying lower (signalling) current, the sensor signal conditioner U3 and the controller element U1 are connected to the load being protected using lighter gauge wiring than is used to carry the current for the load (the pump motor in FIG. 2). In consequence of the topology allowed by the invention, a load control system (LCS) for protecting several loads using a single ASSD is possible.

Referring now to FIG. 2, an LCS according to the invention is shown incorporated into an electromechanical system having different loads A, B and C powered in parallel. According to the invention, a sense resistor and a switch is provided for each load, and in series with power to the load, as in FIG. 2. In addition, a sense resistor and switch is provided for the loads overall, i.e. for the main power line. Now in at least some embodiments of an LCS according to the invention—and as shown in FIG. 2—a single ASSD 20 receives sensor signals from all of the different loads and from the main power sensor, and in response provides switch commands to the switches for each load and for the main power switch. In some embodiments, the control of all the different loads (and the main power) using a single ASSD is achieved using an ASSD network hub 31, which in effect acts as a router, providing to the ASSD 20 sensor signals from each of the different loads, and directing the response from the ASSD 20 back to the respective load. An LCS according to the invention is thus a distributed system, with some components—sense resistors and switches—embedded in (or arranged so as to be closely coupled to) the various loads and so at different locations, and with still other elements—the ASSD 20 and the ASSD network hub 31 (which may be combined with the ASSD 20 as a single package)—installed at yet even one or more other locations, with the aim always of minimizing the unnecessary use of heavy gauge electrical wire (unless other considerations, such as survivability, outweigh the disadvantage of using heavy gauge electrical wire where it is not necessary).

Still referring to FIG. 2, in some embodiments, the ASSD network hub 31 samples the sense resistors for the different loads in a predetermined order, and the ASSD is then able to monitor the sensor signals for each of the different loads (so as to adapt to changing nominal values, as described above) based on the order in which it receives the sensor signals. Other embodiments are of course also possible, such as embodiments in which the ASSD network hub provides with a sensor signal an identification of the corresponding load, or at least some means of associating sensor signals from a load at one time, with sensor signal from the same load at another time. Of course, when using an ASSD for controlling current for more than one load, the ASSD would include a data store 22 of nominal values for each of the different loads (which of course could be a single database).

As mentioned above, and now referring also to FIG. 2, instead of merely a sense resistor $R_s$ and a switch RY1, a LCM can be incorporated into each load and also into the main power line. In such embodiments, the ASSD 20 (and in particular the ASSD controller U1) could provide higher level monitoring and control (i.e. monitoring and control for a load based not only on sensed parameters for the load but based on sensed parameters for others of the loads also), or the LCM could merely provide values for more than one sensed parameter and the ASSD 20 could determine any appropriate response.

In some embodiments one or more control panels each with a human interface are integrated into the LCS. The control panels may span simple indicator configurations to advanced graphical displays. Input methods may include simple pushbuttons and switches to keyboards and touch-sensitive screens. The use of control relays in a load control system is known, but control relays do not adapt to changing parameter values (or provide other intelligent functioning), and so do not take full advantage of locating intelligence (for purposed of control) proximal to the load for which power is being controlled. The use of LCMs in the present invention takes advantage of dropping prices in microcontrollers and related components to offer superior functionality and value at costs not far removed from other, lesser means of system configuration and control.

Figure 3:
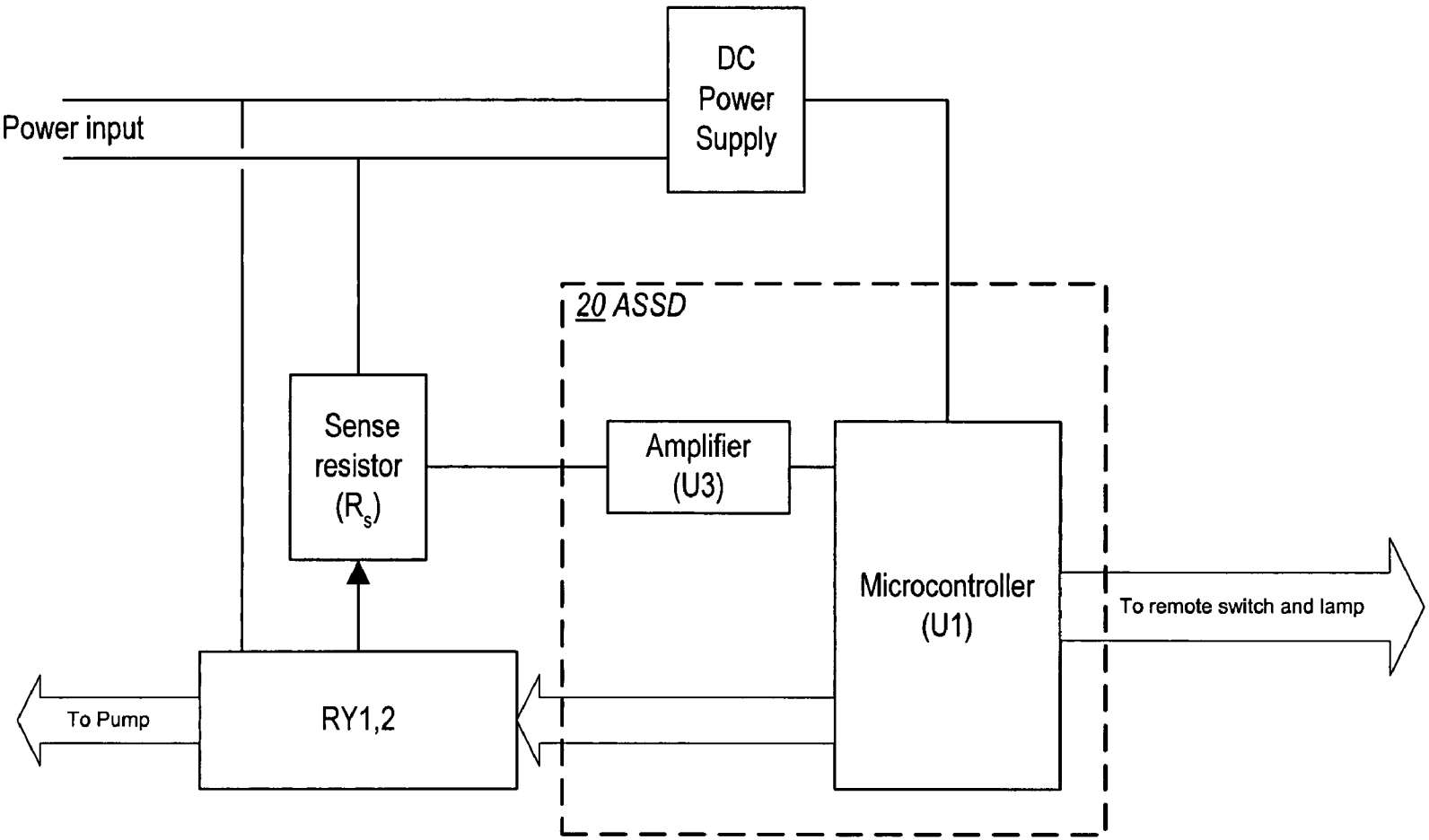
FIG. 3 is a hardware-oriented block diagram of an ASSD according to the invention, and showing also signalling of an optional additional switch and LED indicator.

Referring now to FIG. 3, an ASSD 20 according to the invention is shown with the U1 device/controller providing signals for a remote (customer-supplied) switch and lamp (e.g. an LED signalling panel), in addition to providing signalling for the relays RY1 (and possibly RY2, and so on).

Networking Aspects of the Invention

Figure 4:
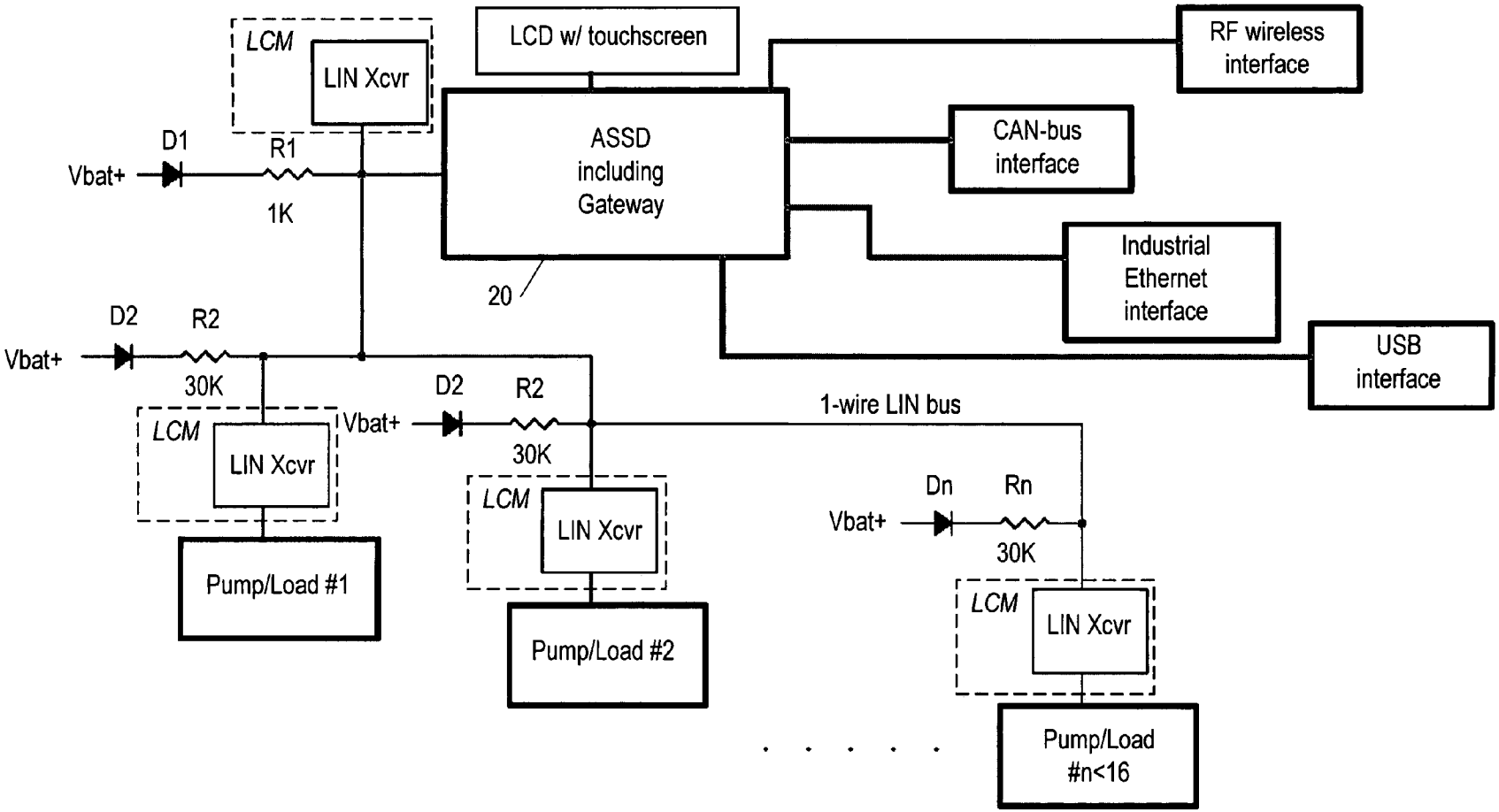
FIG. 4 is a network-oriented view of the invention illustrating module for providing network communication functionality for communication between the ASSD and the load control modules of FIG. 2.

As described above, the ASSD 20 communicates, in some embodiments, with intelligent LCMs. Referring now to FIG. 4, in enabling such communication, the ASSD advantageously includes network communication functionality for enabling communication with the LCMs. Advantageously, the ASSD also includes gateway functionality for enabling such communication using different (network) protocols. One such protocol that is especially advantageous when cost is a major factor is the protocol for network communication over a so-called LIN (Local Interconnect Network) bus, which is a one-wire bus. LIN is a low cost, industry standard. Other kinds of buses used advantageously, depending on the application, include: an Ethernet bus, a USB (universal serial) bus, a CAN (controller area network) bus, or a wireless network bus such as e.g. Wi-Fi (IEEE802.11b/g) or Bluetooth (in which cases the "bus" is air).

The LIN bus is a simple but effective one-wire bus that (at this time) can connect up to 16 devices (a master device plus 15 slave devices) at a distance of up to 40 meters. Maximum data speed is 20 kbps. In an embodiment in which an LCM communicates with the ASSD (and so the controller U1) via a LIN bus, serial digital data signals are referenced to the vehicle ground and the battery voltage minus one diode drop, and so typically data signals are about 12 V peak-to-peak on a 12 V system. The bus is not fault tolerant. There can be multiple buses; a two-bus system can have 32 nodes. The physical configuration on the network can be a star or daisy chain. Each LCM would have a unique address (1–16) embedded into EEPROM memory via a serial interface or switches. Data is bi-directional, and so commands for ON or OFF from the master control/gateway in the controller U1 can be sent to the unique addresses, and status and diagnostic information can be read back from the LCM unit.

The ASSD human interface can be as simple as pushbutton switches with a two-line by 16-character LCD dot matrix display and only one LIN bus port, or as full-featured as a color LCD screen typical of DVD entertainment devices in vehicles with a touch screen. There is typically only one ASSD per system; hence it is hardly ever as cost sensitive as the individual LCM units.

CONCLUSION

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An active sensing and switching device (20) for use in controlling current to a load, comprising a controller means (U1) for disconnecting the load from a power source by providing a switch-open control signal based on a signal indicating a sensed value of electrical current to the load, characterized in that the controller means (U1) determines a nominal value for the electrical current to the load based on monitoring over a period of time the signal indicating the sensed value of electrical current to the load.

2. An active sensing and switching device as in claim 1, further characterized in that the controller means (U1) provides the switch-open control signal in case of a difference in the sensed current compared to the nominal value by more than a predetermined amount, and provides a switch-close control signal after a waiting period, but will not provide subsequent switch-close control signals beyond a predetermined number of repetitions in case of repeated indications of sensed current differing from the nominal value by more than the predetermined amount.

3. An active sensing and switching device as in claim 2, further characterized in that the controller means (U1) also determines acceptable variations from the nominal value by monitoring the current during a period of providing current to the load.

4. An active sensing and switching device as in claim 1, further comprising sensor signal conditioner means (U3) for conditioning the signal indicating the sensed value of electrical current to the load so as to be suitable for use by the controller means (U1), wherein the sensor signal conditioner means (U3) is an operational amplifier configured as a non-inverting amplifier with a gain of approximately four.

5. An active sensing and switching device as in claim 1, wherein the controller means (U1) is provided as a microcontroller having flash program memory.

6. A load control system, comprising an active sensing and switching device as in claim 1 and adapted to receive signals indicating sensed values of electrical current to a plurality of respective loads, and further comprising a plurality of load control modules adapted so as to be disposed in proximity to respective loads or a main power line, wherein the load control modules provide respective signals indicating sensed values of electrical currents to the respective loads.

7. A load control system as in claim 6, wherein the load control module comprises:

switching means (RY1) for disconnecting the load from a power source in response to a switch-open control signal, and for connecting the load in response to a switch-close control signal; and sensing means ($R_s$) for sensing current to the load, and for providing a sensed current signal derived from the sensed current.

8. A load control system as in claim 7, wherein the sensing means ($R_S$) senses current through a resistor formed as a trace of known resistance and placed in series with the load.

9. A load control system as in claim 6, wherein the active sensing and switching device (20) provides a command signal to one of the load control modules based not only on a signal from the load control module indicating a sensed value of electrical current to the respective load, but also based on at least one signal from another of the load control modules indicating a sensed value of electrical current to the load to which the other of the load control modules is proximally located.

10. A load control system as in claim 6, wherein the active sensing and switching device (20) includes network communication functionality allowing communication between the active sensing and switching device and the load control modules using a network protocol.

11. A load control system as in claim 10, wherein the active sensing and switching device (20) further includes a network protocol converter allowing communication between the active sensing and switching device and the load control modules using different network protocols.

12. A method, including a controller step of disconnecting a load from a power source by providing a switch-open control signal based on a signal indicating a sensed value of electrical current to the load, characterized in that the controller step determines a nominal value for the electrical current to the load based on monitoring over a period of time the signal indicating the sensed value of electrical current to the load.

13. A method as in claim 12, further characterized in that the controller step provides the switch-open control signal in case of a difference in the sensed current compared to the nominal value by more than a predetermined amount, and provides a switch-close control signal after a waiting period, but does not provide subsequent switch-close control signals beyond a predetermined number of repetitions in case of repeated indications of sensed current differing from the nominal value by more than the predetermined amount.

14. A method as in claim 13, further characterized in that the controller step also determines acceptable variations from the nominal value by monitoring the current during a period of providing current to the load.

* * * * *